US005426621A

United States Patent [19]

Akasaka

[11] Patent Number: 5,426,621

[45] Date of Patent: Jun. 20, 1995

[54] LUMINOUS DIAL PLATE STRUCTURE FOR WATCHES

[75] Inventor: Masayuki Akasaka, Ota, Japan

[73] Assignee: Kabushiki Kaisha Hattori Seiko, Tokyo, Japan

[21] Appl. No.: 294,380

[22] Filed: Jul. 26, 1994

[30] Foreign Application Priority Data

Jul. 27, 1993 [JP] Japan ..... 5-185228

[51] Int. Cl.[6] ..... G04B 19/32; G04B 19/06

[52] U.S. Cl. ..... 368/226; 368/232

[58] Field of Search ..... 368/67, 223, 226–228, 368/232–234, 239; 362/23, 26, 27, 29, 34, 62, 84; 427/66

[56] References Cited

U.S. PATENT DOCUMENTS

| | | | |
|---|---|---|---|
| 3,436,242 | 4/1969 | Schaffner | 368/226 |
| 4,285,055 | 8/1981 | Takami et al. | 368/226 |
| 4,775,964 | 10/1988 | Alessio et al. | 368/67 |
| 5,086,418 | 2/1992 | Marcus | 368/226 |
| 5,346,718 | 9/1994 | Thorgersen et al. | 427/66 |

*Primary Examiner*—Vit W. Miska

*Attorney, Agent, or Firm*—Stroock & Stroock & Lavan

[57] ABSTRACT

Provided is a luminous dial plate structure for watches, relatively high in luminance, sufficiently long in visual time and abundant in ornamental effect. The dial plate structure is composed of a lower plate and an upper member. The lower plate is made of a metal such as brass. The upper surface of the lower plate is coated with a phosphorescence-maintaining luminous agent made of a rare-earth element metal oxide. The surface of phosphorescence-maintaining luminous agent is coated with clear lacquer serving as a sealing material. The upper member is made of a thin transparent or translucent material, on which a time indication scale is provided. The upper member is bonded through an adhesive onto the upper surface of clear lacquer. In a bright place the dial plate shows such an indication that the time indication scale on the upper member is directly seen, while in a dark place the phosphorescence-maintaining luminous agent illuminates the upper member from the back to make the time indication scale visually observed as black shadows.

21 Claims, 3 Drawing Sheets

LUMINOUS DIAL PLATE STRUCTURE FOR WATCHES

BACKGROUND OF THE INVENTION

1. Field of the Invention

The present invention relates to a luminous dial plate structure for watches, and more particularly to a luminous dial plate structure for watches using a phosphorescence-maintaining luminous agent, abundant in ornamental effect.

2. Related Background Art

Conventional luminous dial plates for watches are roughly classified into two types, i.e., spontaneous-emission-type luminous dial plates for professional diver's watches and luminous dial plates for general watches utilizing the phosphorescence. The former luminous dial plates for professional diver's watches are provided with a time indication scale which is a coating of radioactive substance such as, promethium or tritium, having such an advantage that the scale is visually recognizable for a long time in a dark environment. However, because the radioactive substances are hazardous, applications are limited only to very special purposes such as the luminous dial plates for professional diver's watches as described above.

Therefore, normal watches broadly use the luminous dial plates utilizing the phosphorescence of sulfur or sulfides, for example of phosphorus.

The conventional luminous dial plates for watches utilizing the phosphorescence of sulfides, however, had such problems that the luminance was relatively low and that an emission time, i.e., a visible time was relatively short, for example about one hour. Further, as for the ornamental effect which is an important factor for watch dial plates, there was no contribution of the phosphorescence, so that a demand has been high to develop a watch dial plate utilizing the phosphorescence also in decoration for watch dial plates.

SUMMARY OF THE INVENTION

It is, therefore, an object of the present invention to provide a luminous dial plate structure for watches, which is relatively high in luminance, sufficiently long in visual time, and affluent in ornamental effect.

The above object of the present invention can be achieved by a luminous dial plate structure for watches, comprising a lower plate, a phosphorescence-maintaining luminous agent provided on the lower plate and made of a rare-earth element metal oxide, and an upper member provided above the phosphorescence-maintaining luminous agent and having a time indication portion.

In one aspect of the invention, the phosphorescence-maintaining luminous agent is a mixture of a rare earth element such as europium (Eu) or dysprosium (Dy) and a metal oxide which are sintered via an appropriate binder. In another aspect the upper member is made of a transparent material. In another aspect the upper member is made of a translucent material.

The dial plate structure further comprises a sealing material between the phosphorescence-maintaining luminous agent and the upper member.

In one aspect, the phosphorescence-maintaining luminous agent is a coating applied substantially over the entire surface of the lower plate.

The time indication portion is formed on either one of the upper surface and the lower surface of the upper member. The time indication portion may be formed by vapor deposition or by printing.

In another aspect, the lower plate has a number of recesses adjacent to each other, and the recesses are filled with the phosphorescence-maintaining luminous agent.

In still another aspect, the upper member is made of a metal. In this case, the metal upper member comprises a time indication portion remaining in a line pattern and through holes other than the line pattern.

In still another aspect, the phosphorescence-maintaining luminous agent is printed on the surface of the lower plate by the screen printing method. In this case, the phosphorescence-maintaining luminous agent is printed as graduations and numerals for time reading. Also, the time indication portion comprises outlines of graduations and numerals corresponding to those of the phosphorescence-maintaining luminous agent. In this case, the time indication portion may be printed by the screen printing method. The outlines may be printed in a color or in an achromatic color.

The phosphorescence-maintaining luminous agent applied on the lower plate illuminates the upper member from the back. The time indication portion formed on the upper member interrupts the emission from the phosphorescence-maintaining luminous agent, so that it can be visually observed as shadows. Because of this feature of visual recognition as shadows, time hands for reading the time are also visually recognized by their shadows. This allows normal hands to be used without modification. Since the phosphorescence-maintaining luminous agent illuminates the time indication portion like back light, it makes possible to attain dial plate decoration different in appearance from the conventional luminous dial plates for watches. Particularly, a dial plate indication in a light place can be arranged as completely different from that in a dark place.

Further, three-dimensional decoration is possible, because the luminous dial plate is composed of the lower plate on which the phosphorescence-maintaining luminous agent is applied and the upper member on which the time indication portion is formed.

The rare-earth element metal oxide is higher in luminance and far longer in visual time than the conventional luminous agents of sulfides.

BRIEF DESCRIPTION OF THE DRAWINGS

FIG. 1 is a vertical cross-sectional view to show the first embodiment of luminous dial plate structure for watches according to the present invention;

DESCRIPTION OF THE PREFERRED EMBODIMENTS

Embodiments of luminous dial plate structure for watches according to the present invention will be described with reference to FIG. 1 to FIGS. 6A, 6B.

Figure 1:
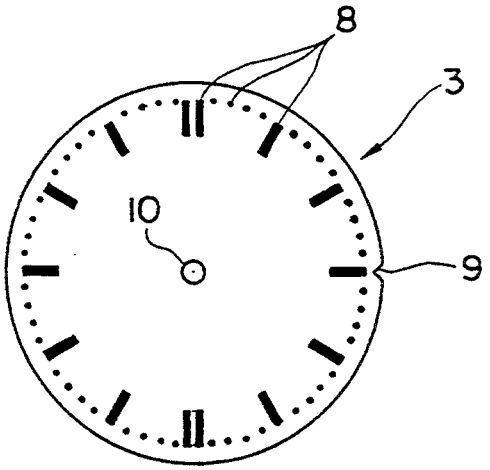
FIG. 1 is a plan view to show an upper member in a first embodiment.
Figure 2:
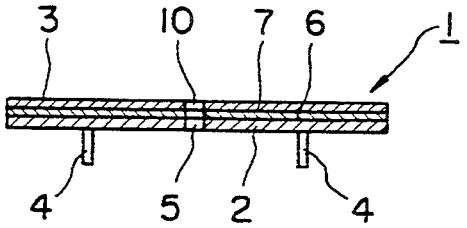

FIG. 1 and FIG. 2 show the first embodiment of the present invention, in which a dial plate 1 is roughly composed of a lower plate 2 and an upper member 3 located above it. The lower plate 2 is made of a metal, for example brass. Mounting legs project from the lower surface of the lower plate 2 and a through hole 5 is bored through the center thereof. The mounting legs 4 are fixed to a watch movement or module not shown, whereby the lower plate 2 is mounted on the watch movement. A shaft to which watch hands are attached is inserted through the through hole 5.

The entire upper surface of the lower plate 2 is coated with a phosphorescence-maintaining luminous agent 6 made of a rare-earth element metal oxide. This rare earth element metal oxide is preferably obtained by mixing a rare earth element, such as europium (Eu) or dysprosium (Dy), with a metal oxide such as $Al_2O_3$ and by sintering the thus obtained mixture via an appropriate binder. The rare-earth element metal oxide is higher in luminance, shorter in phosphorescent time and far longer in visual time, for example as long as 500 minutes, than the conventional phosphorescence-maintaining luminous agents of sulfides. The surface of the phosphorescence-maintaining luminous agent 6 is coated with clear lacquer 7 serving as a sealing material. The upper surface of this clear lacquer 7 is polished to become plane so that it can be set in close fit with the upper member 3.

The upper member 3 is made of a very thin transparent material, for example a mineral such as sapphire glass, moss agate, or rutile-containing quartz; or a synthetic resin. As shown in FIG. 2, a time indication scale 8 for example for hours and minutes is formed by the vapor deposition of golden color or by the ordinary printing on the upper surface or the lower surface of the upper member 3. Further, the circumference of upper member 3 is cut to form a positioning notch 9 and the center thereof is bored to be a through hole 10.

The upper member 3 as so arranged is bonded through an adhesive onto the upper surface of lower plate 2, more exactly on the upper surface of clear lacquer 7 so that the through hole 10 thereof is coincident with the through hole 5 in the lower plate 2.

The lamination of the lower plate 2 and the upper member 3 is arranged to have a thickness substantially equal to that of ordinary dial plates.

The operation of the first embodiment is next described.

In a bright place appearance of the dial plate 1 is such that the time indication scale 8 provided on the upper member 3 looks shining in a golden color or that the scale 8 of the printed color is directly observed. In contrast, in a dark place the phosphorescence-maintaining luminous agent 6 illuminates the upper member 3 from the back like back light and the time indication scale 8 interrupts the light from the phosphorescence-maintaining luminous agent 6, so that a watch user can visually recognize the time indication scale 8 as black shadows.

As described above, the dial plate 1 can indicate such completely different scale indications, i.e., one in a bright portion different from another in a dark portion. Further, three-dimensional decoration is possible, because the dial plate 1 is composed of the lower plate 2 on which the phosphorescence-maintaining luminous agent 6 is applied and the upper member 3 on which the time indication scale 8 is formed.

Although the above first embodiment is so arranged that the phosphorescence-maintaining luminous agent 6 is applied over the entire upper surface of the lower plate 2, the agent can be locally applied expecting the ornamental effect.

Further, the upper member 3 may be made of a translucent material such as very thin Japanese paper, fabric or wood hardened with a synthetic resin or the like in order to enhance the ornamental effect. Printing a chromatic or achromatic time indication scale on the surface of such translucent material, the time indication scale of printed color(s) can be visually recognized in superposition on a pattern of Japanese paper, fabric, nonwoven cloth or wood in a bright place, while the pattern of Japanese paper, . . . and the time indication scale can be visually recognized as black shadows under the light from the phosphorescence-maintaining luminous agent 6 in a dark place.

Figure 3:
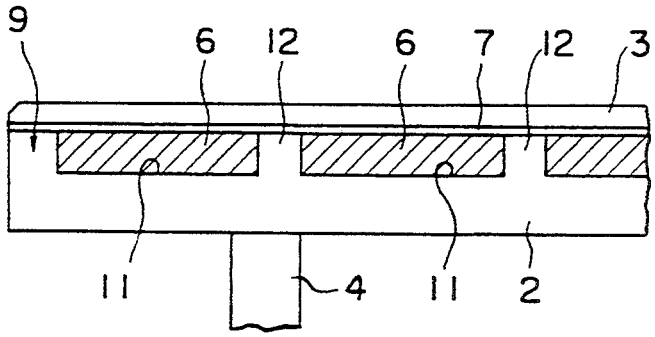
FIG. 3 is a vertical cross-sectional view to show a second embodiment of luminous dial plate structure for watches according to the present invention.
Figure 4:
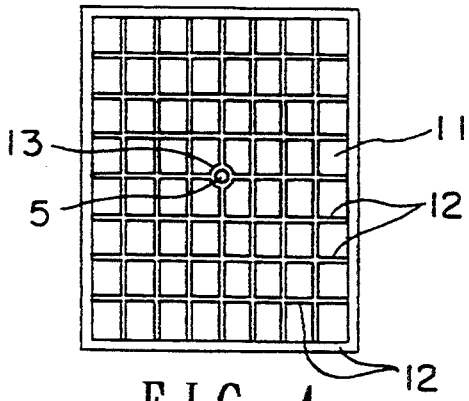
FIG. 4 is a plan view to show a lower plate in the second embodiment.
Figure 5:
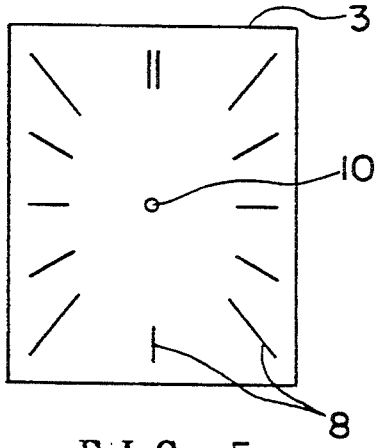
FIG. 5 is a plan view to show an upper member in the second embodiment.

FIG. 3 to FIG. 5 show the second embodiment of the present invention.

In FIG. 3, mounting legs 4 project from the lower surface of a metal lower plate 2, and a number of rectangular recesses 11 are engraved or pressed on the upper surface thereof. These recesses 11 are arranged close to each other and linear frames 12 for separating the recesses 11 are defined to have a substantially same width, or depth as clearly shown in FIG. 4. Also, a circular frame 13 is formed around a through hole 5. The height of the circular frame 13 is the same as that of the linear frames 12.

The recesses 11 are filled with the phosphorescence-maintaining luminous agent 6, and a filling amount of the phosphorescence-maintaining luminous agent 6 is determined such that the surface of phosphorescence-maintaining luminous agent 6 becomes substantially coincident with the upper surface of frames 12. The surface of phosphorescence-maintaining luminous agent 6 is coated with clear lacquer 7 and the surface of clear lacquer 7 is polished to be plane. An upper member 3 made of translucent frosted glass is bonded through an adhesive onto the surface of clear lacquer 7 or onto the surface of the linear frames 12.

As shown in FIG. 5, a through hole 10 is bored through the center of the upper member 3 and a time indication scale 8 is printed on the upper surface thereof.

As so arranged, the grid sections of phosphorescence-maintaining luminous agent 6 illuminate the glass upper member 3 from the back in a dark place, revealing such an ornamental effect that the moonlight is observed through a shoji screen at a full-moon night.

The phosphorescence-maintaining luminous agent 6 may be screen-printed in a rectangular pattern without engraving or pressing the recesses 11 on the upper surface of the lower plate 2. However, the thickness of phosphorescence-maintaining luminous agent 6 in this case is thinner than that in the embodiment of FIG. 3, which would lower the luminance and make outlines of phosphorescence-maintaining luminous agent 6 somewhat unclear.

In the third embodiment of the present invention, the entire upper surface of the lower plate is coated with a phosphorescence-maintaining luminous agent in the same manner as in the first embodiment and clear lacquer is further applied onto the agent. An upper member made of a metal such as stainless steel is bonded through an adhesive to the lamination. The metal upper member is so formed that a line pattern is constructed of time indication scale portions, time indication numeral portions, a peripheral portion, a surrounding portion around a through hole for hands, and connecting portions for connecting between them and that the remaining portions are through holes. That is, the upper member is produced by removing portions except for the above line pattern portions from a very thin metal plate for example by photoetching.

In this case, part of light from the phosphorescence-maintaining luminous agent is interrupted by the line pattern in the upper member but the rest passes through the through holes in the upper member, considerably improving the contrast as compared with the above embodiments.

Figure 6A:
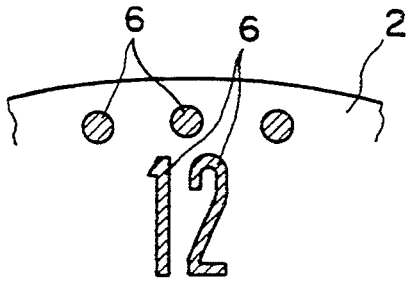
FIGS. 6A and 6B are a partial plan view to show an upper member and a partial plan view to show a lower plate, respectively, in a fourth embodiment.
Figure 6B:
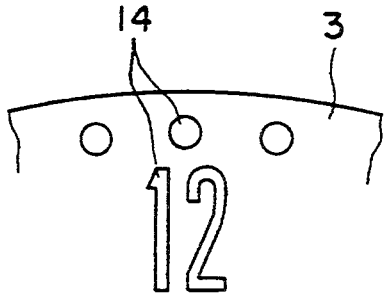

FIG. 6A and FIG. 6B show the fourth embodiment of the present invention. FIG. 6A shows a surface of a lower plate, on which time reading numerals and minute graduations are printed as solid numerals and solid dots by the screen printing method with a phosphorescence-maintaining luminous agent made of a rare-earth element metal oxide. FIG. 6B shows a surface of a translucent upper member, on which only outlines of numerals and dots, which are formed in same shapes and at same positions as those in FIG. 6A but are not solid numerals or dots, are trim-printed. Then the upper member is bonded through an adhesive onto the lower plate so as not to cause a mutual shift of the prints.

As apparent from the above description, the present invention can provide decoration of dial plate different in appearance from the conventional luminous dial plates for watches, because the upper member is illuminated from the back by the phosphorescence-maintaining luminous agent applied on the upper surface of the lower plate. Especially, the present invention can show dial plate indications in a bright place and in a dark place completely different from each other. Also, three-dimensional decoration is possible, because the luminous dial plate is composed of the lower plate on which the phosphorescence-maintaining luminous agent is applied and the upper member on which the time indication portion is provided. Further, since the rare-earth element metal oxide is used as the phosphorescence-maintaining luminous agent, the dial plate of the invention is higher in luminance and far longer in visual time than the conventional luminous agents of sulfides.

What is claimed is:

1. A luminous dial plate structure for watches, comprising:

a lower plate;

a phosphorescence-maintaining luminous agent provided on said lower plate and made of a rare-earth element metal oxide; and an upper member provided above said phosphorescence-maintaining luminous agent and having a time indication portion.

2. A luminous dial plate structure for watches according to claim 1, wherein said phosphorescence-maintaining luminous agent is a mixture of a rare earth element and a metal oxide which are sintered via an appropriate binder.

3. A luminous dial plate structure for watches according to claim 2, wherein said rare-earth metal is an europium (Eu).

4. A luminous dial plate structure for watches according to claim 2, wherein said rare earth metal is a dysprosium (Dy).

5. A luminous dial plate structure for watches according to claim 2, wherein said metal oxide is $Al_2O_3$.

6. A luminous dial plate structure for watches according to claim 1, wherein said upper member is made of a transparent material.

7. A luminous dial plate structure for watches according to claim 1, wherein said upper member is made of a translucent material.

8. A luminous dial plate structure for watches according to claim 1, further comprising a sealing material between said phosphorescence-maintaining luminous agent and said upper member.

9. A luminous dial plate structure for watches according to claim 1, wherein said phosphorescence-maintaining luminous agent is a coating applied substantially over the entire surface of said lower plate.

10. A luminous dial plate structure for watches according to claim 1, wherein said time indication portion is formed on either one of an upper surface and a lower surface of said upper member.

11. A luminous dial plate structure for watches according to claim 1, wherein said time indication portion is formed by vapor deposition.

12. A luminous dial plate structure for watches according to claim 1, wherein said time indication portion is formed by printing.

13. A luminous dial plate structure for watches according to claim 1, wherein said lower plate has a number of recesses adjacent to each other and wherein said recesses are filled with said phosphorescence-maintaining luminous agent.

14. A luminous dial plate structure for watches according to claim 1, wherein said upper member is made of a metal.

15. A luminous dial plate structure for watches according to claim 10, wherein said metal upper member comprises a time indication portion remaining in a line pattern and through holes other than the line pattern.

16. A luminous dial plate structure for watches according to claim 1, wherein said phosphorescence-maintaining luminous agent is printed on the surface of the lower plate by the screen printing method.

17. A luminous dial plate structure for watches according to claim 12, wherein said phosphorescence-maintaining luminous agent is printed as graduations and numerals for time reading.

18. A luminous dial plate structure for watches according to claim 13, wherein said time indication portion comprises outlines of graduations and numerals corresponding to those of the phosphorescence-maintaining luminous agent.

19. A luminous dial plate structure for watches according to claim 14, wherein said time indication portion is printed by the screen printing method.

20. A luminous dial plate structure for watches according to claim 14, wherein said outlines are printed in a color.

21. A luminous dial plate structure for watches according to claim 14, wherein said outlines are printed in an achromatic color.

* * * * *